US012378705B2

(12) United States Patent
Sarabia-Riquelme et al.

(10) Patent No.: US 12,378,705 B2
(45) Date of Patent: Aug. 5, 2025

(54) ELECTRICALLY-CONDUCTING POLYMER YARN AND METHOD OF MAKING SAME

(71) Applicant: University of Kentucky Research Foundation, Lexington, KY (US)

(72) Inventors: Ruben Sarabia-Riquelme, Lexington, KY (US); Matthew C. Weisenberger, Lawrenceburg, KY (US)

(73) Assignee: University of Kentucky Research Foundation, Lexington, KY (US)

( * ) Notice: Subject to any disclaimer, the term of this patent is extended or adjusted under 35 U.S.C. 154(b) by 0 days.

(21) Appl. No.: 18/540,795

(22) Filed: Dec. 14, 2023

(65) Prior Publication Data

US 2024/0200237 A1 Jun. 20, 2024

Related U.S. Application Data

(60) Provisional application No. 63/464,136, filed on May 4, 2023, provisional application No. 63/433,532, filed on Dec. 19, 2022.

(51) Int. Cl.

| | |
|---|---|
| ***D02G 3/44*** | (2006.01) |
| ***D01D 5/06*** | (2006.01) |
| ***D02G 3/04*** | (2006.01) |
| ***D02G 3/26*** | (2006.01) |

(52) U.S. Cl.
CPC ..... *D02G 3/441* (2013.01); *D01D 5/06* (2013.01); *D02G 3/045* (2013.01); *D02G 3/26* (2013.01); *D10B 2321/12* (2013.01); *D10B 2401/16* (2013.01)

(58) Field of Classification Search
CPC ..... D02G 3/441; D02G 3/045; D02G 3/26; D01D 5/06; D10B 2321/12; D10B 2401/16
See application file for complete search history.

(56) References Cited

U.S. PATENT DOCUMENTS

| | | | | |
|---|---|---|---|---|
| 2005/0208300 | A1* | 9/2005 | Magill | D04H 3/16 428/364 |
| 2008/0170982 | A1* | 7/2008 | Zhang | B32B 18/00 423/447.3 |
| 2009/0029620 | A1* | 1/2009 | Miura | A41D 31/14 442/364 |
| 2020/0240047 | A1* | 7/2020 | Inamdar | B29B 15/105 |
| 2020/0299863 | A1* | 9/2020 | Sarabia-Riquelme | D01D 5/12 |

* cited by examiner

*Primary Examiner* — Patrick J. Lynch
(74) *Attorney, Agent, or Firm* — Stites & Harbison PLLC; Warren D. Schickli

(57) ABSTRACT

A method for making electrically-conductive yarn includes simultaneously drawing and axially twisting a starting material selected from a group consisting of intrinsically electrically-conducting fiber nonwovens and multifilament tows of intrinsically electrically-conducting fiber. The resulting yarn is a compacted, intrinsically electrically-conducting fiber material having an axial twist of between about 0.5 and about 60 degrees.

6 Claims, 7 Drawing Sheets

ELECTRICALLY-CONDUCTING POLYMER YARN AND METHOD OF MAKING SAME

RELATED APPLICATIONS

This application claims priority to U.S. Provisional Patent Application Ser. No. 63/433,532, filed on Dec. 19, 2022, and U.S. Provisional Patent Application Ser. No. 63/464,136, filed on May 4, 2023, both of which are hereby incorporated by reference in their entirety.

STATEMENT REGARDING FEDERALLY SPONSORED RESEARCH OR DEVELOPMENT

This invention was made with government support under grant number 1849213 awarded by the National Science Foundation. The government has certain rights in the invention.

TECHNICAL FIELD

This document relates to a new and improved electrically-conducting polymer yarn and to a new and improved method for making an electrically-conducting polymer yarn from intrinsically electrically-conducting fiber nonwovens and multifilament tows of intrinsically electrically-conducting fiber.

BACKGROUND

Electronic textiles are a rapidly emerging field with great commercial potential. Current approaches towards manufacturing electrically conducting yarns involve coating a conductive material (often poly (3,4-ethylenedioxythiophene):poly(styrene sulfonate) (PEDOT:PSS)) onto an existing textile yarn made out of a traditional insulating material (such as cotton, polyester, spandex, etc). Unfortunately, the resultant material is characterized by relatively low electrical conductivity since most of the material is comprised of the insulating yarn support.

In contrast, the method disclosed in this document directly fabricates electrically-conductive yarns from intrinsically electrically-conducting fiber nonwovens and multifilament tows of intrinsically electrically-conducting fiber without the need of any other material. This advantageously results in a yarn having relatively high electrical conductivity and other desired properties such as ionic conductivity and biocompatibility.

SUMMARY

In accordance with the purposes and benefits set forth herein, a method for making electrically-conductive yarn, comprises, consists of or consists essentially of simultaneously drawing and axially twisting a starting material selected from a group consisting of intrinsically electrically-conducting fiber nonwovens and multifilament tows of intrinsically electrically-conducting fiber. The starting material may be selected from a group of polymer fiber materials consisting of polyacetylene, a polythiophene, a polypyrrole, a polyaniline, a polyphenylene, and complexed derivatives and blends thereof.

In at least some of the many possible embodiments, the method includes wetting the starting material with a compacting solvent prior to the twisting. In some embodiments, the method includes wetting the starting material with a compacting solvent during the twisting. In still other embodiments, the method includes wetting the starting material with a compacting solvent prior to and during the twisting. The compacting solvent may be selected from a group of solvents consisting of acetone, methanol, ethanol, isopropanol, toluene, hexane, xylene, dimethyl sulfoxide, N,N-dimethylformamide, N-methyl-2-pyrrolidone, N,N-dimethylacetamide and mixtures thereof.

In at least some embodiments, the method includes adjusting a draw speed and a twist speed to provide a desired yarn twist angle of between about 0.5 and about 60 degrees. In some embodiments, the axial twist is between about 30 and about 45 degrees.

In accordance with yet another aspect, a method for making electrically-conductive yarn, comprises, consists of or consists essentially of: (a) extruding a dispersion of poly (3,4-ethylenedioxythiophene):poly(styrene sulfonate) (PEDOT:PSS) polymer in a polar solvent through a spinneret into a coagulation bath of non-solvent to the PEDOT:PSS to produce PEDOT:PSS fibers, (b) allowing the PEDOT:PSS fibers to accumulate in the coagulation bath where the PEDOT:PSS fibers entangle forming a mesh, (c) removing the mesh from the coagulation bath and placing it in a wash bath of low polarity solvent, (d) removing the mesh from the wash bath and allowing the mesh to dry, and (e) simultaneously drawing and axially twisting the mesh to make the electrically-conductive yarn.

Such a method may further include using a moving belt immersed in the coagulation bath to transfer the PEDOT:PSS fibers to the wash bath. Still further, the method may include using the moving belt immersed in the wash bath to transfer the mesh from the wash bath for drying.

In at least some embodiments, the method further includes wetting the mesh with a compacting solvent prior to and during the twisting. The method may include adjusting a draw speed and a twist speed to provide a desired yarn twist angle of between about 0.5 and about 60 degrees. The method may include adjusting a draw speed and a twist speed to provide a desired yarn twist angle of between about 30 and about 45 degrees.

In accordance with yet another aspect, a new and improved electrically-conductive yarn is provided. That yarn comprises, consists of or consists essentially of a compacted, intrinsically electrically-conducting fiber material having an axial twist of between about 0.5 and about 60 degrees. In some embodiments, the axial twist is between about 30 and about 45 degrees. The electrically-conducting yarn may be made from a polymer fiber material selected from a group consisting of a polyacetylene, a polythiophene, a polypyrrole, a polyaniline, a polyphenylene, and complexed derivatives and blends thereof.

In the following description, there are shown and described several different embodiments of the new and improved method for making electrically-conductive yarn and the electrically-conductive yarn. As it should be realized, the method and yarn are capable of other, different embodiments and their several details are capable of modification in various, obvious aspects all without departing from the method and yarn as set forth and described in the following claims. Accordingly, the descriptions should be regarded as illustrative in nature and not as restrictive.

BRIEF DESCRIPTION OF THE DRAWING FIGURES

The accompanying drawing figures incorporated herein and forming a part of the specification, illustrate certain aspects of the method and the electrically-conducting yarn produced by the method and together with the description serve to explain certain principles thereof. A person of ordinary skill in the art will readily recognize from the following discussion that alternative embodiments of the method and yarn may be employed without departing from the principles described below.

Reference will now be made in detail to the present preferred embodiments of the apparatus and method.

DETAILED DESCRIPTION

Figure 1:
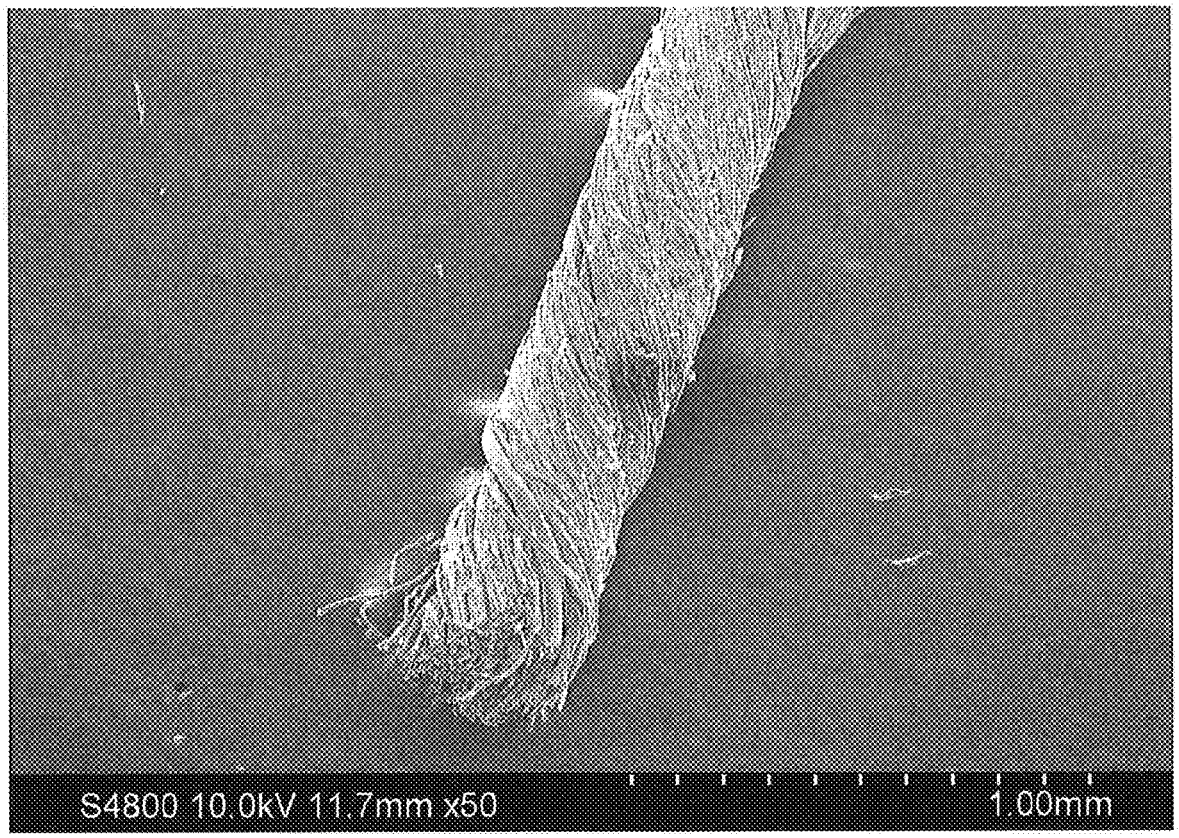
FIG. 1 is a scanning electron microscope (SEM) image of an electrically-conducting yarn fabricated by the method described in this document.
Figure 2:
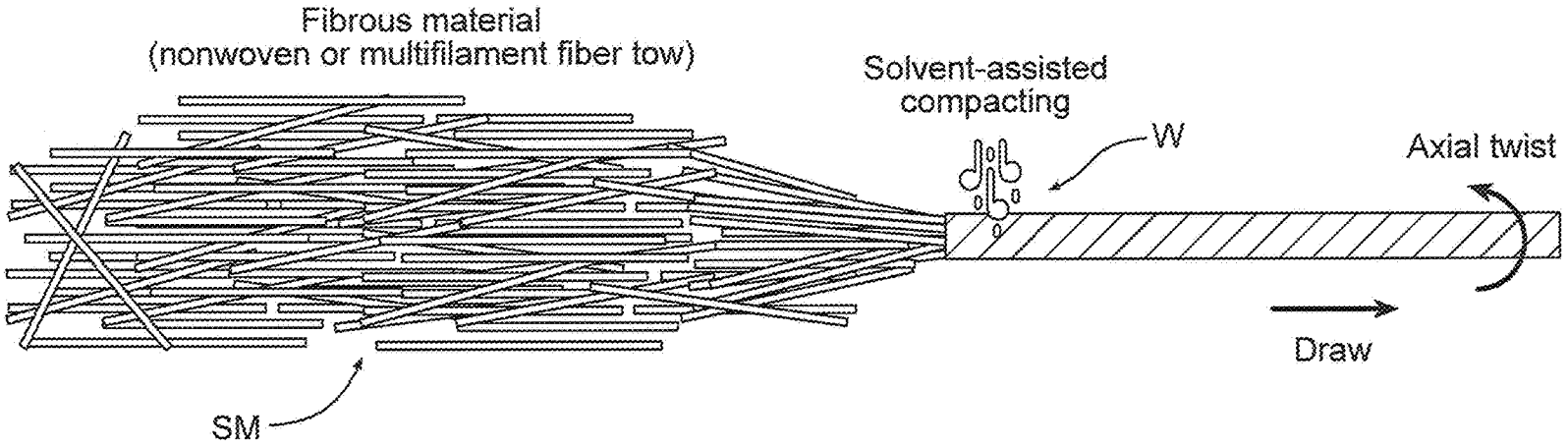
FIG. 2 is a schematic illustration of the method.
Figure 3:
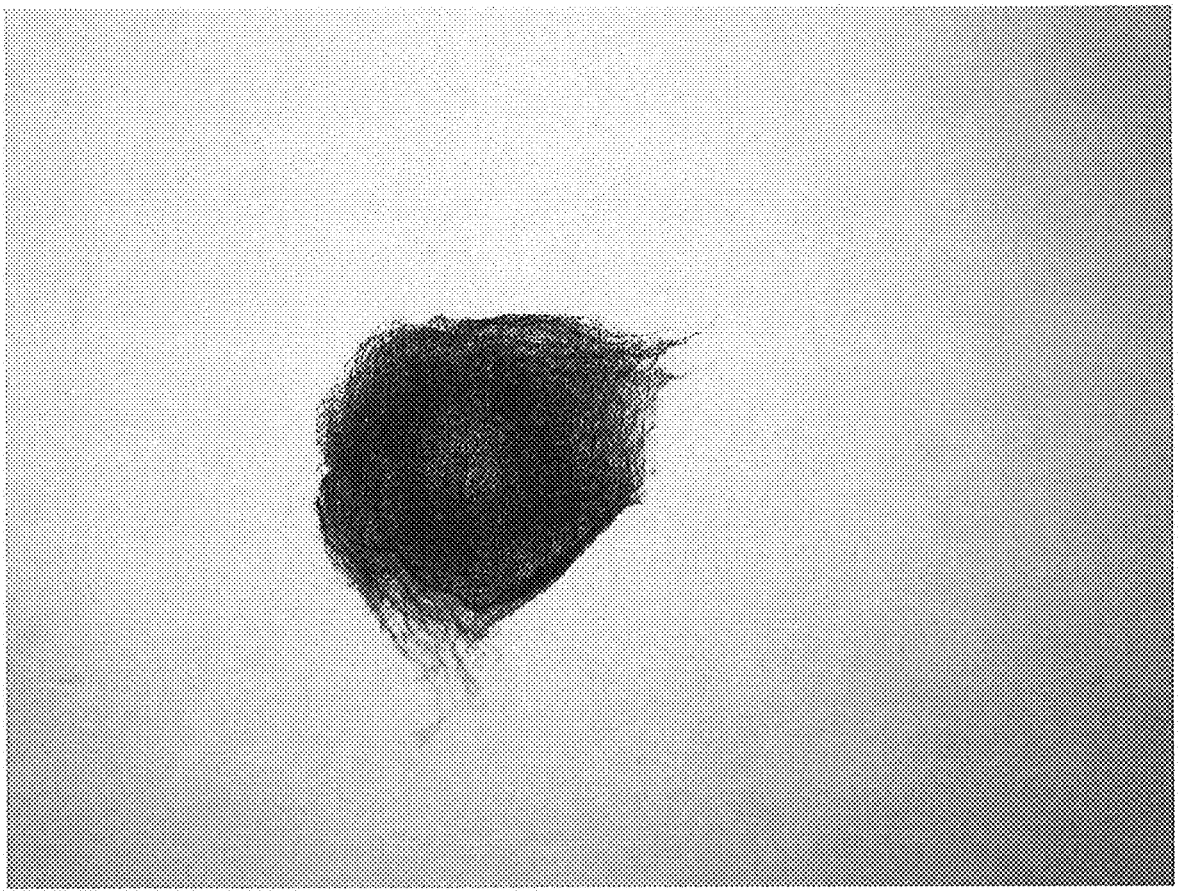
FIG. 3 is a photograph of a PEDOT:PSS nonwoven mesh fabricated using the non-continuous method.
Figure 4:
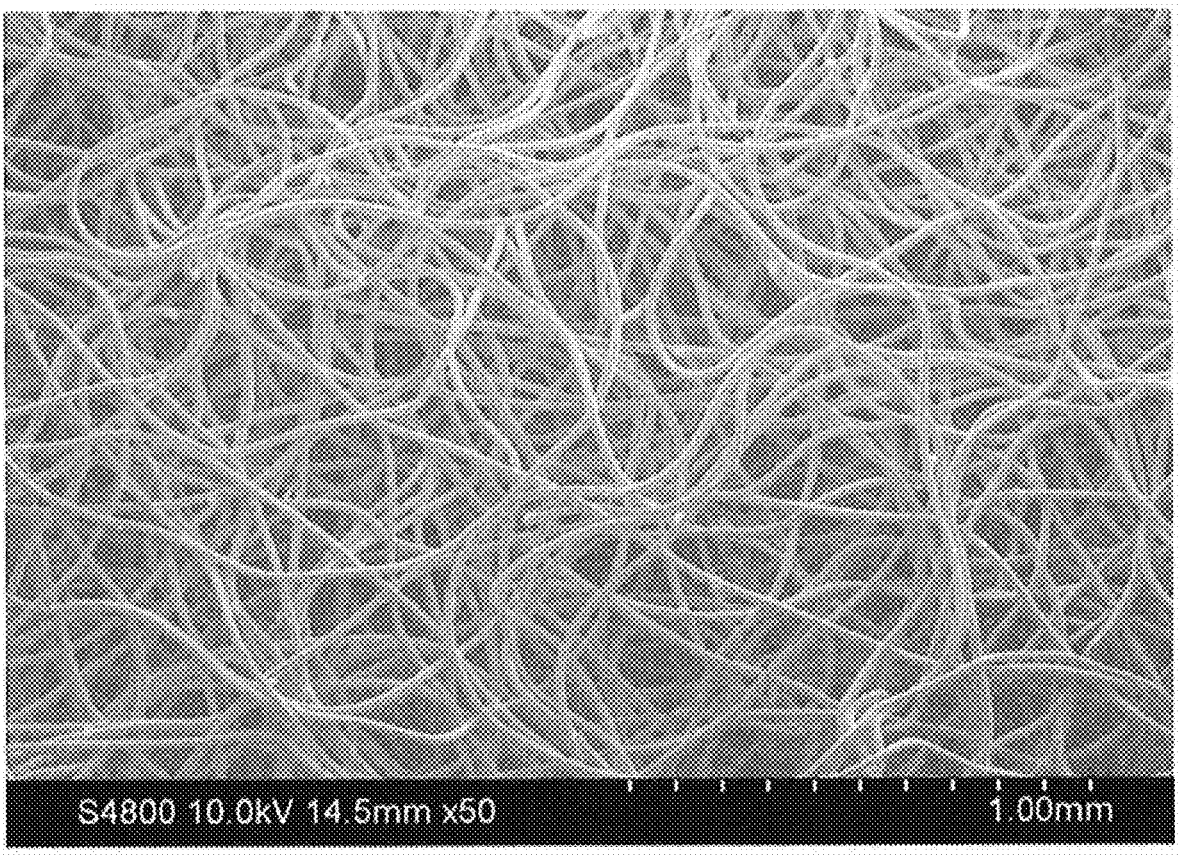
FIG. 4 is a SEM image of the PEDOT:PSS nonwoven mesh of FIG. 3 from the top.
Figure 5:
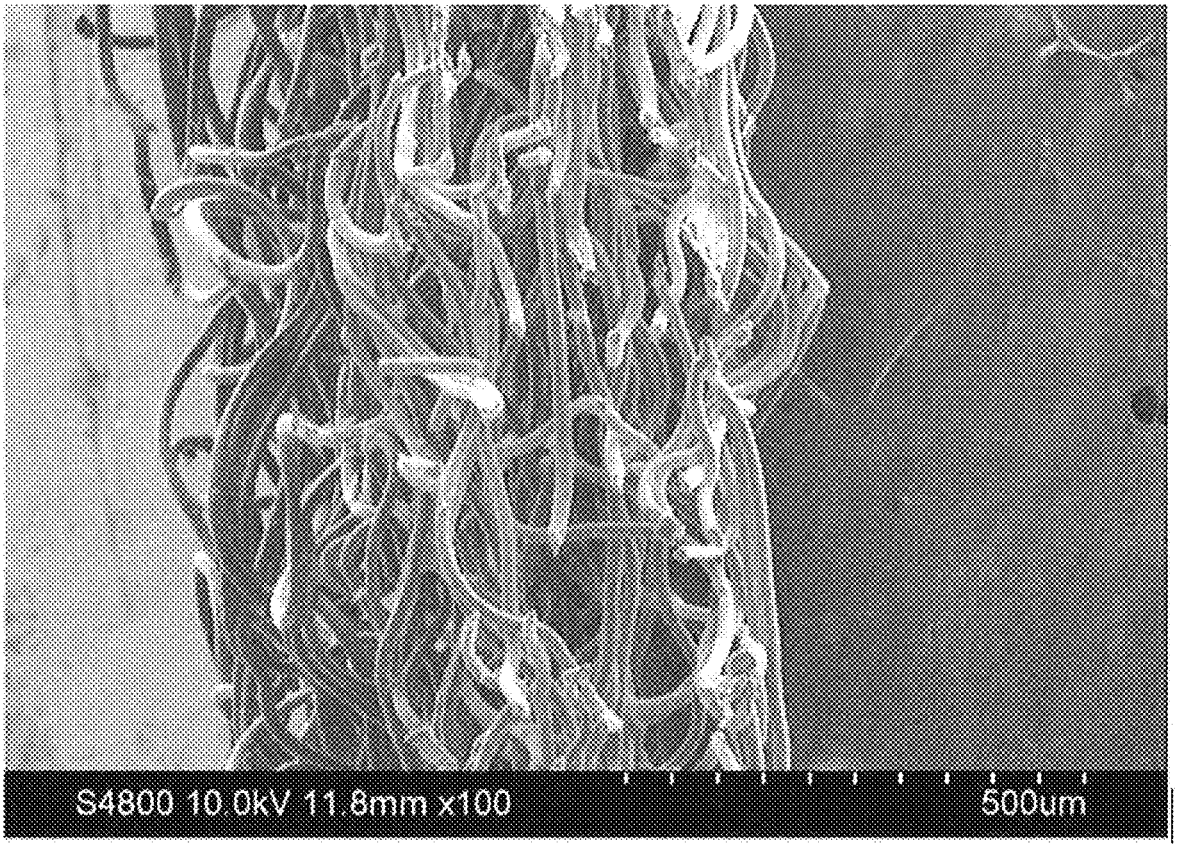
FIG. 5 is a SEM image of the PEDOT:PSS nonwoven mesh of FIG. 3 from the side.
Figure 6:
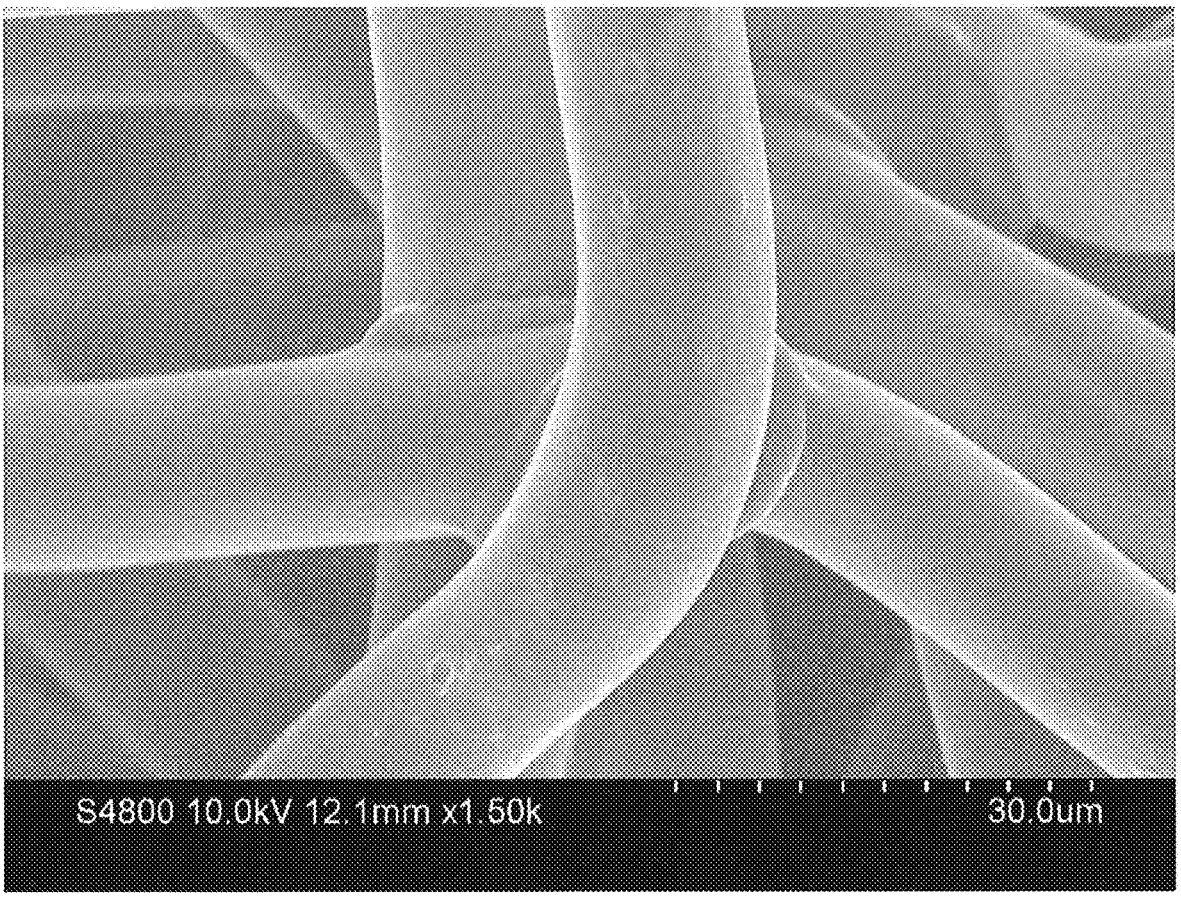
FIG. 6 is a SEM image showing fiber bonding at the touchpoints.

Reference is now made to FIG. 1 which is a SEM image of the electrically-conducting yarn that may be made by the new and improved method that is illustrated in FIG. 2 and described in greater detail below. The yarn is made by simultaneously drawing and axially twisting a starting material SM selected from a group consisting of intrinsically electrically-conducting fiber nonwovens and/or multifilament tows of intrinsically electrically-conducting fiber. The twist imparted to the starting material effectively collapses the starting material into a yarn, compacting the fibers. The yarn shown in FIG. 1 made is from poly(3,4-ethylenedioxythiophene):poly(styrene sulfonate) (PEDOT:PSS).

More specifically, the starting material useful in the method may be made from, for example,

- Polyacetylenes
- Polythiophenes such as poly (3-alkylthiophene) (P3HT) and poly (3,4-ethylenedioxythiophene (PEDOT).
- Polypyrroles
- Polyanilines
- Polyphenylenes such as poly(phenylene vinylene) and poly(2,5-dialkoxy-p-phenylene vinylene)
- Also including their complexed derivatives and blends such as poly(3,4-ethylenedioxythiophene):poly(styrene sulfonate) (PEDOT:PSS).

Fiber diameters are typically in the range of between about 5 and about 50 microns. Fiber shapes are typically round in cross section but could also be bean shaped or any other shape. Any number of fibers may be processed at any one time including tows having fiber counts of between about 10 and about 10,000.

In one or more of the many possible embodiments of the method, the method further includes the step of wetting the starting material with a compacting solvent at W. This wetting of the starting material may be performed (a) before twisting, (b) during twisting or (c) before and during twisting. The compacting solvent may be selected from a group of solvents consisting of acetone, methanol, ethanol, isopropanol, toluene, hexane, xylene, dimethyl sulfoxide, N,N-dimethylformamide, N-methyl-2-pyrrolidone, N,N-dimethylacetamide and mixtures thereof. This is done in order to shrink the starting material into a compact yarn increasing its density. Once wetted, the surface tension pulls the fibers together. As the compacting solvent evaporates, a dry-densified yarn is formed. Compact yarns have increased strength, and result in low yarn breaks during further processing.

In one or more of the many possible embodiments, the method further includes adjusting the draw speed and the twist speed of the yarn to provide a desired yarn twist angle of between about 0.5 and about 60 degrees. In one particularly useful embodiment, the yarn twist angle is between about 30 degrees and about 45 degrees. This may be done using a fiber draw twister machine of a type known in the art.

The electrically-conducting yarns, fabricated by the present method, may be used in common textile fabrication processes such as sewing, crocheting, knitting, weaving, embroidery, etc. Advantageously, the yarns intrinsically conduct electricity and, therefore, are suitable to be used as the building block for the fabrication of electronic and smart textiles. The electrically conductive yarns produced by the present method are characterized by electrical conductivity of between about 100 S/cm and about 10000 S/cm which is several orders of magnitude larger than provided by the state-of-the-art coated textile yarns noted above. Advantageously, this results in low internal resistance for devices and circuits fabricated using these yarns. The lower internal resistance translates into higher signal to noise ratio in sensing devices, more efficient power generation and energy storage textile devices, and reduced power consumption.

Reference is now made to FIGS. 3-6 which show a mesh of PEDOT:PSS fibers of the type that may be used (a) in a method for making electrically-conductive yarn for use as the fundamental building block for multiple electronic textile applications or (b) for strain or pressure sensors for human motion monitoring. Such nonwovens made of PEDOT:PSS fibers can be fabricated using a method comprised of the following steps: (a) extruding a dispersion of PEDOT:PSS polymer in a polar solvent (such as but not limited to water, dimethyl sulfoxide (DMSO), ethylene glycol (EG) and mixtures) through a spinneret into a coagulation bath of non-solvent to the PEDOT:PSS (such as but not limited to acetone or isopropanol) to produce PEDOT:PSS fibers, (b) allowing the PEDOT:PSS fibers to accumulate in the coagulation bath where they entangle forming a mesh, (c) removing the mesh from the coagulation bath and placing it in a wash bath of low polarity solvent (i.e. a solvent having a relative polarity of less than 0.15 such as but not limited to toluene or hexane), and (d) removing the mesh from the wash bath and allowing it to dry either at room temperature or by application of heat.

Figure 7:
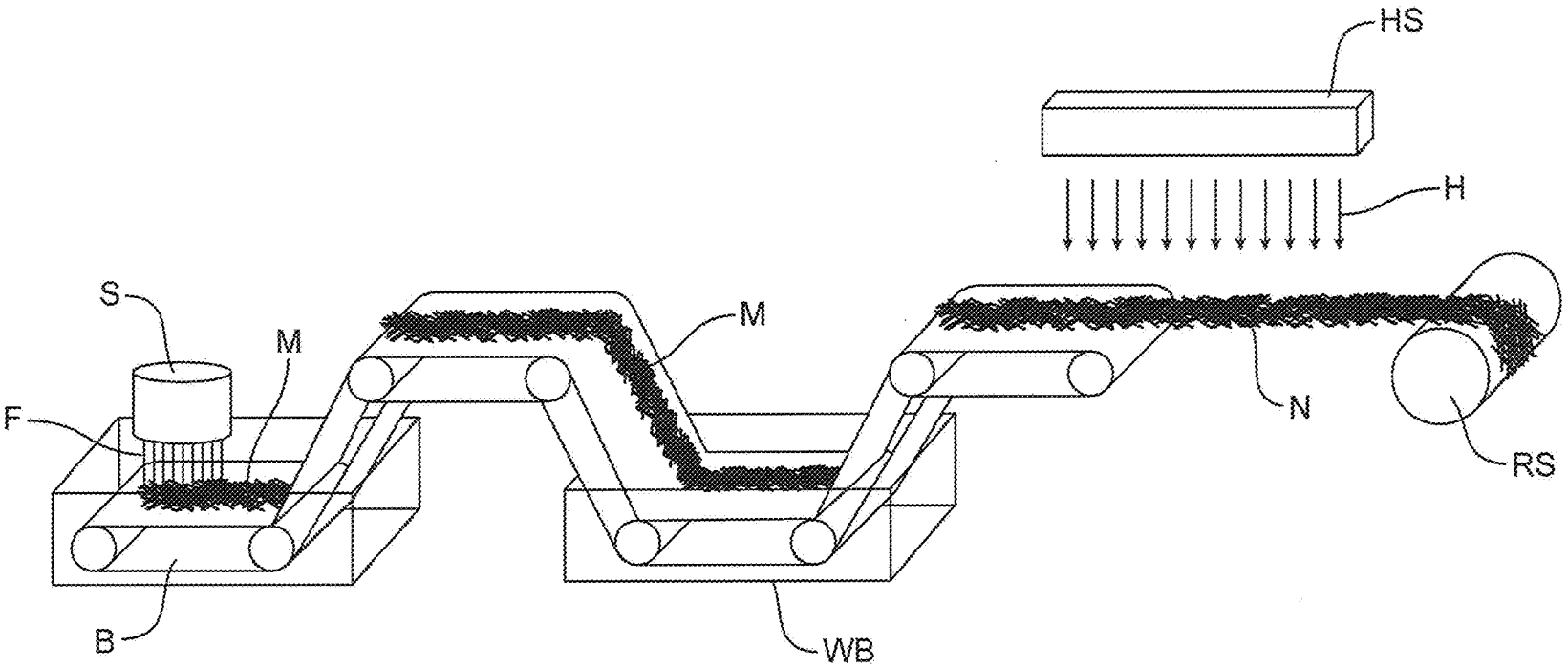
FIG. 7 is a schematic representation of the method for continuous fabrication of PEDOT:PSS nonwoven mesh.

As illustrated in FIG. 7, the method described above can be easily scaled up towards a continuous process using a moving belt B. The continuous process comprises the following steps. Similar to step (a) of the method above, a dispersion of PEDOT:PSS is extruded through a spinneret S into a coagulation bath CB (acetone or isopropanol) forming fibers F. The fibers F deposit on top of a moving belt B immersed in the coagulation bath forming a mesh M. The moving belt B exits the coagulation bath CB with the mesh M and enters a wash bath WB (toluene or hexane). The moving belt B then exits the wash bath WB and the mesh M of fibers F is dried, by the application of heat H from the heat source HS, forming the nonwoven N. Next, the dried nonwoven N is detached from the moving belt B and continuously wound on a rotating spool RS.

The main advantage of PEDOT:PSS nonwovens with respect to other nonwoven materials is that PEDOT:PSS nonwovens conduct electricity (stemming from PEDOT:PSS intrinsic electrical conductivity). This is of major importance in the emerging field of electronic textiles. Current approaches towards electrically conducting nonwovens involve coating a conductive material (often PEDOT:PSS) into an existing textile nonwoven made out of a traditional insulating material (such as cotton, polyester, spandex, etc), with the major drawback that the resultant electrical conductivity is low since most of the material is comprised of the insulating nonwoven support.

Our method directly fabricates the nonwoven from PEDOT:PSS fibers without the need of any other material (support or other) which results in high electrical conductivity and other desired properties such as ionic conductivity and biocompatibility. Moreover, in traditional nonwoven fabrication processes of thermoplastic polymers, a post-treatment of the nonwoven called bonding is typically performed to create fusion points between the fibers that impart robustness to the nonwoven. Here, the resulting PEDOT:PSS nonwoven already shows fusion at fiber touch-points (see particularly FIG. 6) avoiding the need for a post-treatment step. Such a yarn with these fusion points at random angles is more robust and therefore less likely to break and fray upon handling/running through textile machinery.

In contrast, conventional spinning of multifilament yarns leads to excessive interfilament fusion causing the filaments to stick and coalesce together along their lengths to the extent that they become stick-like and do not have the desired suppleness for use as yarn in textile machinery. Advantageously, the present method of yarn fabrication set forth in this document avoids the interfilament fusion issue characteristic of conventional multifilament yarn spinning.

Each of the following terms written in singular grammatical form: "a", "an", and "the", as used herein, means "at least one", or "one or more". Use of the phrase "One or more" herein does not alter this intended meaning of "a", "an", or "the". Accordingly, the terms "a", "an", and "the", as used herein, may also refer to, and encompass, a plurality of the stated entity or object, unless otherwise specifically defined or stated herein, or, unless the context clearly dictates otherwise. For example, the phrase: "a polymer", as used herein, may also refer to, and encompass, a plurality of polymers.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated component(s), feature(s), characteristic(s), parameter(s), integer(s), or step(s), and does not preclude addition of one or more additional component(s), feature(s), characteristic(s), parameter(s), integer(s), step(s), or groups thereof.

The phrase "consisting of", as used herein, is closed-ended and excludes any element, step, or ingredient not specifically mentioned. The phrase "consisting essentially of", as used herein, is a semi-closed term indicating that an item is limited to the components specified and those that do not materially affect the basic and novel characteristic(s) of what is specified. Terms of approximation, such as the terms about, substantially, approximately, etc., as used herein, refers to ±10% of the stated numerical value.

Although the method and yard of this disclosure have been illustratively described and presented by way of specific exemplary embodiments, and examples thereof, it is evident that many alternatives, modifications, or/and variations, thereof, will be apparent to those skilled in the art. Accordingly, it is intended that all such alternatives, modifications, or/and variations, fall within the spirit of, and are encompassed by, the broad scope of the appended claims.

What is claimed:

1. A method for making electrically-conductive yarn, comprising:

extruding a dispersion of poly (3,4-ethylenedioxythiophene):poly(styrene sulfonate) (PEDOT:PSS) polymer in a polar solvent through a spinneret into a coagulation bath of non-solvent to the PEDOT:PSS to produce PEDOT:PSS fibers;

allowing the PEDOT:PSS fibers to accumulate in the coagulation bath where the PEDOT:PSS fibers entangle forming a mesh;

removing the mesh from the coagulation bath and placing it in a wash bath of a solvent having a relative polarity of less than 0.15;

removing the mesh from the wash bath and allowing the mesh to dry; and simultaneously drawing and axially twisting the mesh to make the electrically-conductive yarn.

2. The method of claim 1, using a moving belt immersed in the coagulation bath to transfer the PEDOT:PSS fibers to the wash bath.

3. The method of claim 2, further including using the moving belt immersed in the wash bath to transfer the mesh from the wash bath for drying.

4. The method of claim 3, further including wetting the mesh with a compacting solvent prior to and during the twisting.

5. The method of claim 4, further including adjusting a draw speed and a twist speed to provide a desired yarn twist angle of between about 0.5 and about 60 degrees.

6. The method of claim 5, further including adjusting a draw speed and a twist speed to provide a desired yarn twist angle of between about 30 and about 45 degrees.

* * * * *